US009428860B2

(12) United States Patent
White et al.

(10) Patent No.: US 9,428,860 B2
(45) Date of Patent: Aug. 30, 2016

(54) METHOD OF DEWATERING A FORMING FABRIC IN A PAPER MAKING MACHINE

(71) Applicant: RPM Technologies, Inc., Ludlow, MA (US)

(72) Inventors: James D. White, Belchertown, MA (US); Karl Lemme, Blanford, MA (US)

(73) Assignee: RPM TECHNOLOGIES, INC., Ludlow, MA (US)

( * ) Notice: Subject to any disclaimer, the term of this patent is extended or adjusted under 35 U.S.C. 154(b) by 0 days.

(21) Appl. No.: 15/016,108

(22) Filed: Feb. 4, 2016

(65) Prior Publication Data

US 2016/0177504 A1 Jun. 23, 2016

Related U.S. Application Data

(62) Division of application No. 14/577,293, filed on Dec. 19, 2014, now Pat. No. 9,284,685.

(51) Int. Cl.

| | |
|---|---|
| ***D21F 1/54*** | (2006.01) |
| ***D21F 1/00*** | (2006.01) |
| ***D21F 1/66*** | (2006.01) |

(52) U.S. Cl.
CPC ..... *D21F 1/009* (2013.01); *D21F 1/66* (2013.01)

(58) Field of Classification Search
CPC ..... D21F 11/006; D21F 1/483; D21F 1/54
USPC ..... 162/116
See application file for complete search history.

(56) References Cited

U.S. PATENT DOCUMENTS

| | | | |
|---|---|---|---|
| 3,874,998 | A | 4/1975 | Johnson |
| 4,838,996 | A | 6/1989 | Kallmes |
| 5,169,500 | A | 12/1992 | Mejdell |

*Primary Examiner* — Mark Halpern
(74) *Attorney, Agent, or Firm* — Coleman & MacDonald Law Office

(57) ABSTRACT

A method of dewatering a forming fabric in a paper making machine includes moving a forming fabric carrying a slurry stock through a dewatering area of the paper making machine; positioning a foil apparatus for supporting the forming fabric, the foil apparatus having a foil member defining a work surface and a pulse generator coupled to the foil member adjacent the work surface; and forming a nip between the work surface and the forming fabric by positioning the pulse generator relative to the work surface.

3 Claims, 14 Drawing Sheets

METHOD OF DEWATERING A FORMING FABRIC IN A PAPER MAKING MACHINE

CROSS-REFERENCE TO RELATED APPLICATIONS

This application is a divisional of co-pending U.S. patent application Ser. No. 14/577,293 filed Dec. 19, 2014, the entire disclosure of which is hereby incorporated by reference.

FIELD OF THE INVENTION

The present disclosure relates generally to a foil apparatus for a paper making machine and method of use of a foil apparatus. More particularly, the disclosure relates to a foil apparatus having a pulse generator for causing motion within the stock slurry of a paper making machine during a forming process and method of use of the foil apparatus.

BACKGROUND OF THE INVENTION

The statements in this section merely provide background information related to the present disclosure and may not constitute prior art.

Paper mill slurry stock supplied to the forming fabric of a paper machine is made up of fibers and solids in an aqueous solution containing generally from about 99 to about 99.9 percent water. The aim of a paper maker is to mix the slurry stock thoroughly in the head box of a paper making machine so that the fibers will be uniformly dispersed. Despite this attempt, the fibers often tend to agglomerate in the head box and emerge from the slice in clumps or flocs and the slurry stock is deposited on the forming fabric in this condition. If these flocs or fibers remain undispersed, the finished paper will not be of uniform density.

The forming fabric, as used on typical paper making machines, is an open mesh belt of woven cloth. The warp and weft strands of the cloth may be a metal, for example bronze or stainless steel or a plastic material, for instance polyester in multifilament or monofilament form.

Several devices have been used to redistribute fibers in the slurry stock after it has been transferred to the forming fabric during a dewatering process. U.S. Pat. No. 3,874,998 to Johnson discloses a series of replaceable blade elements or drainage foils disposed under the forming fabric to reduce flocculation. The foils disclosed by Johnson include machined grooves or channels in a surface of the foil to provide pressure pulses through the forming fabric which produces controlled agitation of the slurry stock. One drawback of the foil disclosed by Johnson is the channels formed in the foil blades have fixed dimensions, thus, even if a particular foil blade works well with one grade of paper and processing speed, the same blade might not have an appropriate channel for operation with another grade or paper or processing speed.

U.S. Pat. No. 4,838,996 to Kallmes discloses a hydrofoil blade for use in a paper making machine wherein a plurality of variously angulated surfaces is provided for producing turbulence having controllable scale and intensity while independently controlling the rate of dewatering. The Kallmes foil includes a trailing edge of the foil designed to fall away from the forming fabric, thus the foil does not force the stock back through the forming fabric. Similar to the Johnson device, the Kallmes design has a fixed profile that may work well with one grade of paper and speed but not across all grades of paper and machines.

U.S. Pat. No. 5,169,500 to Mejdell teaches an adjustable angle foil for a paper making machine in which a rigid foil member is pivoted by a cam actuated adjustment mechanism to change the foil angle. Similar to the Kallmes foil, adjustment of the foil disclosed by Mejdell may cause a trailing edge to move away from a forming fabric which may reduce a volume of the stock being forced back through the forming fabric.

Each of the above-mentioned devices are used to reduce floccing in a paper making process however, none of the prior art devices are sufficiently adjustable to suit the changing variety of paper grades, weights and processing speeds currently delivered by a typical paper making machine. Accordingly, using the above-described foil blades, a paper maker is often tasked with continuously removing and replacing foil blades of varied specifications in an attempt to maintain high quality paper of various grades and made with differing processing speeds.

It is an object of the present teachings to provide an adjustable pulse generating foil apparatus for a papermaking machine that overcomes the shortcomings of prior art foil devices.

SUMMARY OF THE INVENTION

This section provides a general summary of the disclosure and does provide a comprehensive description or include scope or all the features of the subject matter disclosed.

According to one aspect, the present teachings provide a foil apparatus for a paper making machine including an elongated foil member defining a work surface postionable relative to the forming fabric of a paper making machine, and an elongated pulse generator coupled to the foil member along a length of the foil member. The pulse generator being mounted adjacent to the foil member for forming a nip between the work surface and the forming fabric, the nip for creating movement in a slurry stock of the paper making machine for reducing flocculation.

According to another aspect, the present teachings provide a method of dewatering a forming fabric in a paper making machine, the method including the steps of, moving a forming fabric carrying a slurry stock through a dewatering area of the paper making machine; positioning a foil apparatus for supporting the forming fabric, the foil apparatus comprising an elongated foil member defining a work surface postionable relative to the forming fabric, and an elongated pulse generator coupled to the foil member along a length of the foil member, the pulse generator being mounted adjacent the work surface; and forming a nip between the work surface and the forming fabric by positioning the pulse generator relative to the work surface, the nip for creating movement in a slurry stock of the paper making machine for reducing flocculation.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The present teachings will become more fully understood from the detailed description, the appended claims and the following drawings. The drawings are for illustrative purposes only and are not intended to limit the scope of the present disclosure.

DETAILED DESCRIPTION OF EMBODIMENTS OF THE INVENTION

Detailed illustrative descriptions of example embodiments are disclosed herein. However, specific structural and functional details disclosed herein are merely representative for purposes of describing example embodiments. The example embodiments may be embodied in many alternate forms and should not be construed as limited to only the example embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the term "and/or" includes any and all combinations of one or more of the associated listed items.

It will be understood that when an element is referred to as being "connected," "coupled," "mated," "attached," or "fixed" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between"versus "directly between", "adjacent" versus "directly adjacent", etc.).

The terminology used herein is for the purpose of describing particular embodiments only and is not intended to be limiting of example embodiments. As used herein, the singular forms "a", "an" and "the" are intended to include the plural forms as well, unless the language explicitly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Figure 1:
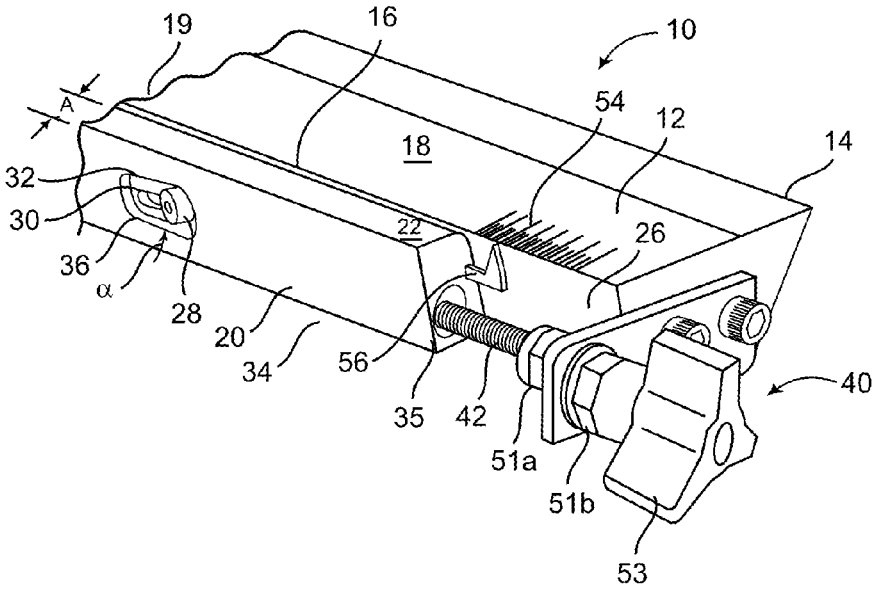
FIG. 1 is a partial perspective view of one embodiment of a foil apparatus in accordance with the present invention.
Figure 2:
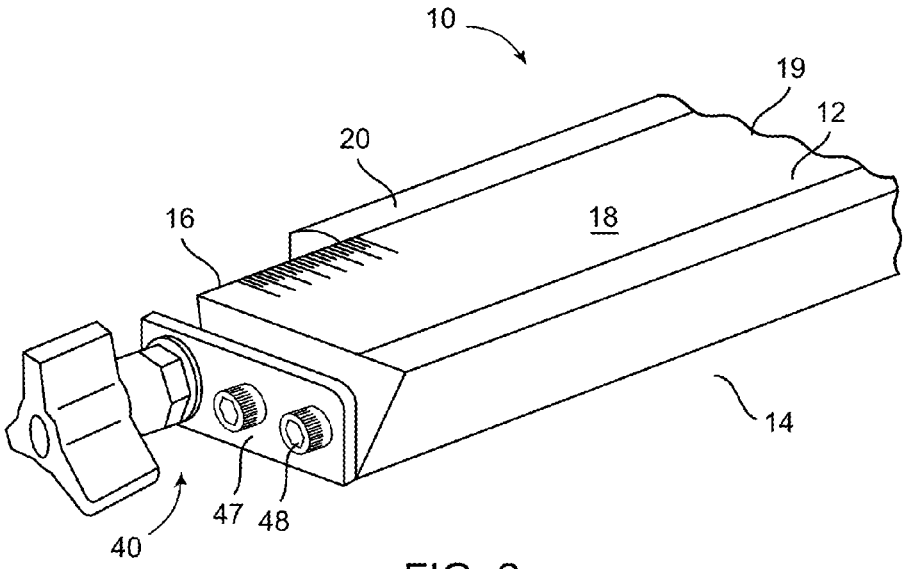
FIG. 2 is another partial perspective view of the foil apparatus of FIG. 1.

FIGS. 1-4 illustrate an example embodiment foil apparatus 10 according to the present invention. The foil apparatus 10 includes an elongated foil member 12 having a leading edge 14 and a trailing edge 16. The foil member 12 defines a working surface 18 disposed between the leading edge 14 and trailing edge 16. An elongated pulse generator 20 is coupled to a side of the foil member 12 for movement relative thereto. FIGS. 1 and 2 include only a partial view of the foil apparatus 10 as denoted by the jagged line 19 shown in the figures; thus, an extended portion of the elongated foil member 12 and pulse generator 20 is omitted from FIGS. 1 and 2.

The pulse generator 20 defines a shaped surface 22 extending throughout a length of the pulse generator and positioned adjacent the trailing edge 16 of the foil member 12. As shown in FIGS. 20-27, the shaped surface 22 can define various contours such as those representative contours illustrated in the figures, for use in various applications of the foil apparatus 10.

Figures 3, 4:
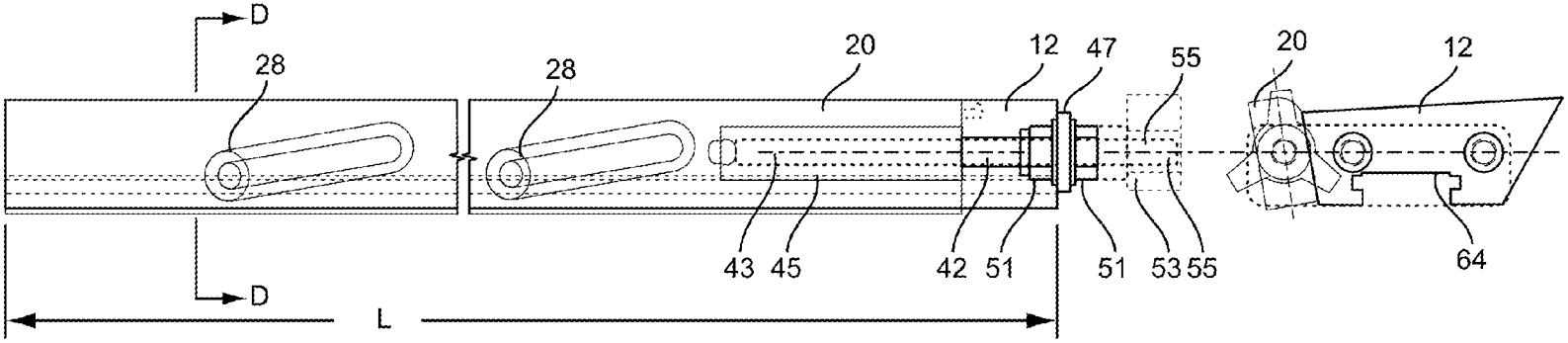
FIG. 3 is a rear side elevation view of the foil apparatus of FIG. 1.
FIG. 4 is an end view of the foil apparatus of FIG. 1 with certain parts omitted for clarity.
Figure 5:
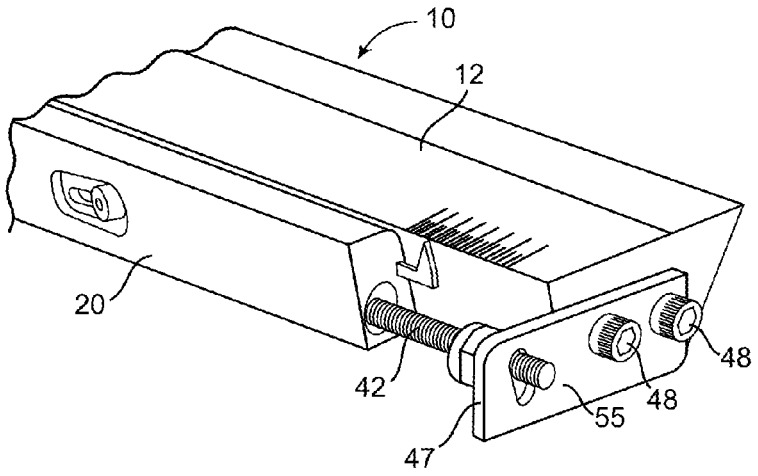
FIG. 5 is a partial perspective view of the foil apparatus of FIG. 1 showing a threaded rod of an actuator with certain parts omitted for clarity.

In the illustrated embodiment, the pulse generator 20 is coupled to a sidewall 26 of the foil member 12 via a plurality of bolts 28 and extends along substantially the entire length of the foil member 12. In the FIGS. 1-3 embodiments, a length of the pulse generator 20 is substantially equal to the length of the foil member 12. The pulse generator 20 defines a plurality of slots 30 extending through a width A of the pulse generator, the bolts 28 pass through the slots 30 and threadably engage corresponding threaded holes defined by the foil member 12. The pulse generator 20 illustrated in FIGS. 1-4 defines a plurality of counter sink slots 32 extending parallel with and surrounding the through slots 30 for receiving a head 31 of the bolts 28. As shown in FIGS. 1, 3, 5, the countersink slots 32 extend through only a portion of the width A of the pulse generator. The pulse generator 20 is coupled to the foil member 12 for slidable movement relative to the foil member via the bolts 28 and slots 30. The bolts 28 may be shoulder bolts wherein the pulse generator is carried on a shoulder 29 (See FIG. 7) of bolts 28; the shoulder being engaged with the slots 30 of the pulse generator for carrying the pulse generator along the length of, and relative to the foil member 12, and during adjustment of the position of the pulse generator. The slots 30, 32 are disposed at an angle α relative to a length of the pulse generator 20. FIG. 1 shows the angle α measured between a lower edge 34 of the pulse generator and a side wall 36 of the countersink slot 32.

Still referring to FIGS. 1-4, an actuator, generally referred to by the reference numeral 40 is provided for adjusting the position of the pulse generator 20 relative to the foil member 12. In one embodiment, the actuator 40 includes a threaded rod 42 having a length aligned with a length L of the pulse generator. In one embodiment, the threaded rod 42 is fixedly attached to the pulse generator via insertion and/or threading of a first end 43 of the rod 42 into an aperture 45 extending into an end 35 of the pulse generator 20. The actuator 40 includes a bracket 47 attached to the foil member 12 via a pair of bolts 48.

Referring to FIGS. 1 and 5, the bracket 47 defines a slot 50 for receiving the second end 55 of the threaded rod 42 therethrough. A pair of jam nuts 51*a* and 51*b* are threaded onto the threaded rod on opposing sides of the bracket 47. A knob 53 is coupled to a second end 55 of the threaded rod 42. The jam nuts 51 and knob 53 are used to move the pulse generator 20 relative to the foil member 12, by backing off one of the jam nuts 51*a*, 51*b* and turning the other of the jam nuts 51*a*, 51*b* against the bracket 47 (i.e., toward the bracket 47), so that the pulse generator 20 will move toward or away from the bracket 47, the angled slots 30 causing the pulse generator 20 and shaped surface 22 thereof, to also move in a direction generally perpendicular to the length L of the pulse generator. The movement of the pulse generator 20 and the shaped surface 22 thereof, above an edge (14, 16) of the working surface 18 of the foil member 12 creates a space or nip 61 (See FIG. 8) for reducing floccing in a paper making process as discussed further hereinbelow.

Figure 8:
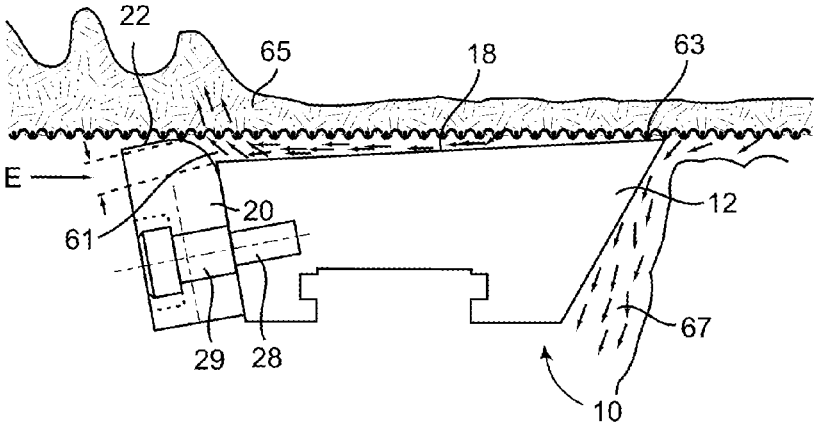
FIG. 8 is a diagram of the foil member and pulse generator of FIG. 7 shown as used in a paper making machine.

Still referring to FIGS. 1-5, in another preferred embodiment of the actuator 40, the jam nuts 51*a* and 51*b* are threadably engaged with the threaded rod 42 on opposing sides of the bracket 47 to fix a position of the threaded rod relative to the bracket 47. The knob 53 is threadably engaged with, and fixed to the second end 55 of the threaded rod 42. A first end 43 of the threaded rod 42 is threadably engaged with the pulse generator 20 at the threaded aperture 45 which extends through the end 35 of the pulse generator and along the length L thereof as shown in FIG. 3. The position of the pulse generator 20 relative to the foil member 12 is adjustable by simply turning the knob 53 in one of a clockwise and counterclockwise direction to raise or lower the position of the shaped surface 22 relative to the working surface 18 of the foil member, respectively. For example, as shown in the FIG. 1, clockwise rotation of the knob 53 moves the pulse generator 20 towards the bracket 47 thereby increasing the volume of the nip 61 (See FIG. 8) due to the angular position of the slot 30. Conversely, rotation of the knob 53 in a counterclockwise direction will move the threaded rod 42 out of the aperture 45 thereby pushing the pulse generator 20 away from the bracket 47 and lowering the shaped surface 22 of the pulse generator relative to the working surface 18, which decreases a volume of the nip 61. (FIG. 8).

In one embodiment of the pulse generator 20, the angle α of the slots 30 is in range of about zero degrees to about 90 degrees. In another embodiment of the pulse generator 20, the angle α of the slots 30 is in a range of about zero degrees to about twenty degrees.

As will be obvious to one skilled in the art, a precision of the movement of the pulse generator 20 relative to the foil member 12 is determined in part by the angle α of the slots 30 and the thread pitch or thread count of the threaded rod 42 of actuator 40. A threaded rod 42 having a larger thread pitch/thread count (finer thread) will move the pulse generator a shorter distance (lengthwise in the direction of the threaded rod 42 and the length L of the pulse generator) per each revolution of the jam nut 51 than a threaded rod 42 having a smaller thread pitch or thread count (coarser thread). Depending on the angle α of the slots 30, rotation of one of the knob 53 will also move the pulse generator 20 in a direction perpendicular to the length L of the pulse generator as set forth above. In one embodiment the threaded rod has a thread count equal to approximately 20 threads per inch. Accordingly, for every 1 turn of one of the threaded rod 42, the pulse generator 20 will move approximately 0.05" toward or away from the bracket 47. In other embodiments of the foil apparatus 10 the threaded rod 42 and corresponding aperture 45 may have different thread counts for adjusting the position of the pulse generator 20 relative to the foil member 12.

Figure 5A:
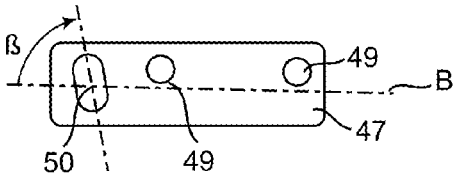
FIG. 5A is a side elevational view of a bracket of the actuator of FIG. 5 showing a detail of the angular slot therein.

The slot 50 defined by the bracket 47 allows for the movement of the pulse generator 20 and threaded rod 42 relative to the foil member 12 in a direction perpendicular to the length L of the pulse generator. As shown in FIGS. 5 and 5*a*, the slot 50 is disposed at an angle β relative to an axis B of the bracket 47 corresponding to a slope of the sidewall 26 of the foil member 12. The angled slot 50 allows the threaded rod 42 to move with the pulse generator in a direction perpendicular to the length L of the pulse generator. Thus, the bracket 47 is configured with the slot 50 being disposed at an angle β corresponding to the slope of the sidewall of the foil member 12 to which the bracket is mounted.

In other embodiments of the foil apparatus disclosed, the pulse generator 20 may be attached to the foil member 12 for movement relative thereto with a different configuration or different fasteners which will be apparent to one skilled in the art and within the scope of the disclosed invention. Also, the actuator 40 may be configured differently including for example, a rotatable cam engaged with the pulse generator, a lever coupled to the pulse generator.

In another embodiment (not shown) the actuator includes a stepper motor coupled to the threaded rod 42 and a controller for automated adjustment of the position of the pulse generator relative to the foil member 12. At least one sensor for determining a position of the pulse generator relative to the foil member is connected to the controller for transmitting an output to the controller.

In one embodiment the slots 30 are configured to allow movement of the pulse generator 20 and the shaped surface 22 thereof to extend above the surface 18 of the foil member 12 in a range from about 0" to about 0.75"; in another embodiment, the slots 30 are configured to allow the shaped surface 22 to extend from about 0.2" below an edge (14, 16) to about 0.5" above an edge (14, 16) of the working surface 18 of the foil member 12. Thus, the configuration of the slots 30 and the threaded rod 42 allow an operator to move the pulse generator relative to the foil member 12 for controlling a dimension of the nip 61 formed between the working surface 18 of the foil member 12, the forming fabric 63 and the shaped surface 22 of the pulse generator 20 as discussed further hereinbelow. (See FIG. 7). In other embodiments of the foil apparatus 10, the range of motion of the pulse generator relative to the working surface 18 in a direction generally perpendicular thereto, can be between about zero to about 1.0 inches.

Referring again to FIG. 1, in another embodiment a pulse generator kit is provided for attaching a pulse generator 20 and actuator 40 to an existing foil member (e.g., foil member 12) of a paper making machine 60. In one embodiment, the pulse generator kit includes a pulse generator 20 as set forth hereinabove, including a shaped surface 22 disposed along a length L thereof, and a plurality of slots 30 extending through a width of the pulse generator. The pulse generator 20 further comprises a threaded rod 42 extending outwardly from an end thereof, or the kit may include a threaded rod 42 attachable to an end of the pulse generator 20. Further, the pulse generator kit may include a plurality of bolts 28 for attaching the pulse generator along the length of a foil member of a paper making machine. The pulse generator kit may include a bracket 47 for coupling the threaded rod to a foil member 12 and one or more bolts 48 for fixing the bracket 47 to the foil member. Additionally, the pulse generator kit may include a pair of jam nuts 51*a*, 51*b* and flat washers for adjustably fixing a position of the pulse generator 20 relative to a foil member 12 as set forth above. The pulse generator kit for modifying an existing foil member 12 for providing an adjustable foil member for use in creating movement in a slurry stock of a paper making machine for reducing flocculation in the slurry stock.

Figure 6A:
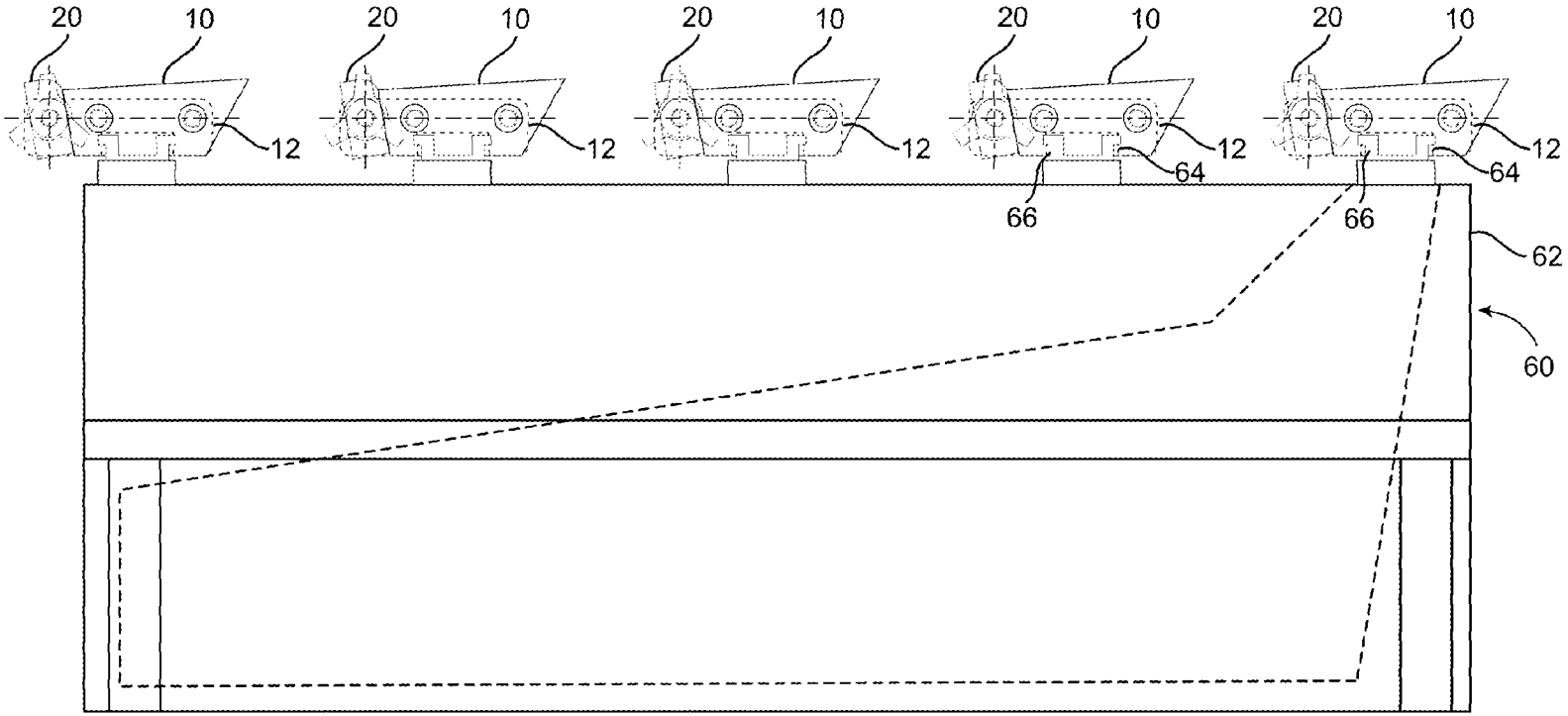
FIG. 6A is a side elevational view of a paper making machine according to the present invention.

FIG. 6A shows a paper making machine 60 having a plurality of the foil apparatus 10 mounted to a frame 62 of the paper making machine in accordance with the present invention. In the FIG. 6A embodiment, the foil members 12 of each of the foil apparatus 10 define a coupler member including a t-slot 64 for receiving a mating coupler member 66. The t-slots 64 and coupler members 66 cooperate in a known arrangement to removably mount the foil apparatus 10 to the paper making machine 60 for use in dewatering a forming fabric in a paper making process. In other embodiments, the foil apparatus 10 may include various other means for coupling the foil member 12 to a paper making machine, e.g. in one embodiment the foil member 12 may define a coupler member having a dovetail configuration for mating with a complimentary coupler member attached to a frame or other support structure. As will be apparent to one skilled in the art, foil apparatus 10 may include various other types of coupler members designed to mount the foil apparatus to a paper making machine, (e.g., other types of fasteners may also be used such as nuts, bolts, clamps, etc.).

Figure 6B:
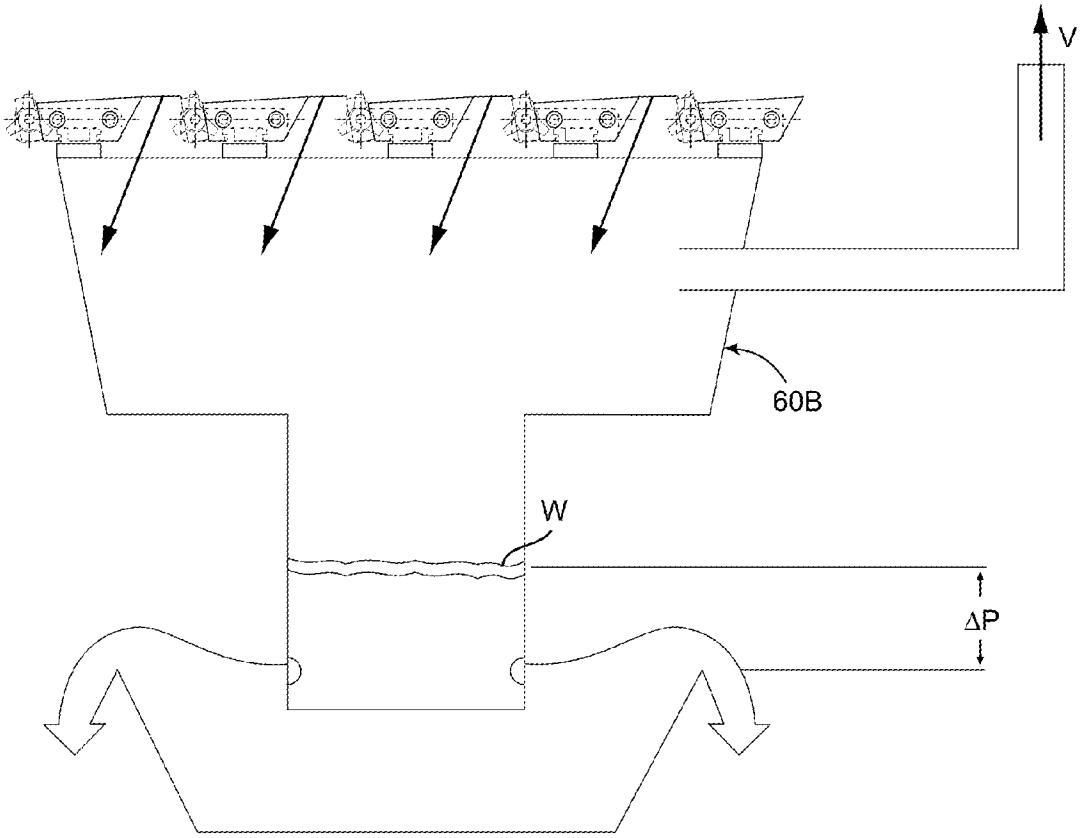
FIG. 6B is a schematic drawing of a vacuum augmented paper making machine having a foil apparatus according to the present invention.

FIG. 6B is an illustration of a plurality of foil apparatus 10 in accordance with the present disclosure shown mounted to a paper making machine 60B having a vacuum augmented dewatering system. As shown in FIG. 6B, the system includes a vacuum source V for creating a negative pressure inside a structure of the machine for assisting in a dewatering process. The foil apparatuses 10 are configured and operate with the vacuum augmented machine 60B in a similar way as that described above with respect to the gravity dewatering system of the paper making machine 60.

In other embodiments, the foil apparatus 10 as disclosed herein can be used on a support structure of a paper making machine in combination with other types of foils, and/or related elements, including fixed foils, fixed stepped blades, adjustable angle or stepped blades and with elements of various widths. For example, in one embodiment, a plurality of foil apparatus 10 pulse generators 20 as disclosed herein can be positioned alternatingly amongst a plurality of standard fixed foils coupled to a paper making machine. One skilled in the art will readily appreciate the advantages of the present invention foil apparatus 10 in that the adjustability of the pulse generator 20 allows an operator to configure a paper making machine including one or more foil apparatus 10 either alone or in combination with various other types of foil elements to provide a paper making machine with flexibility to form papers of various quality and grades from a single machine without requiring continuous changing of foils having fixed specifications or limited adjustability. Thus, due to the numerous variations of possible configurations of one or more pulse generators 20 and positions thereof relative to the foil member 12, the foil apparatus 10 of the present invention provides an adjustable foil apparatus that is greatly improved and surpasses prior art adjustable foils.

Figure 6C:
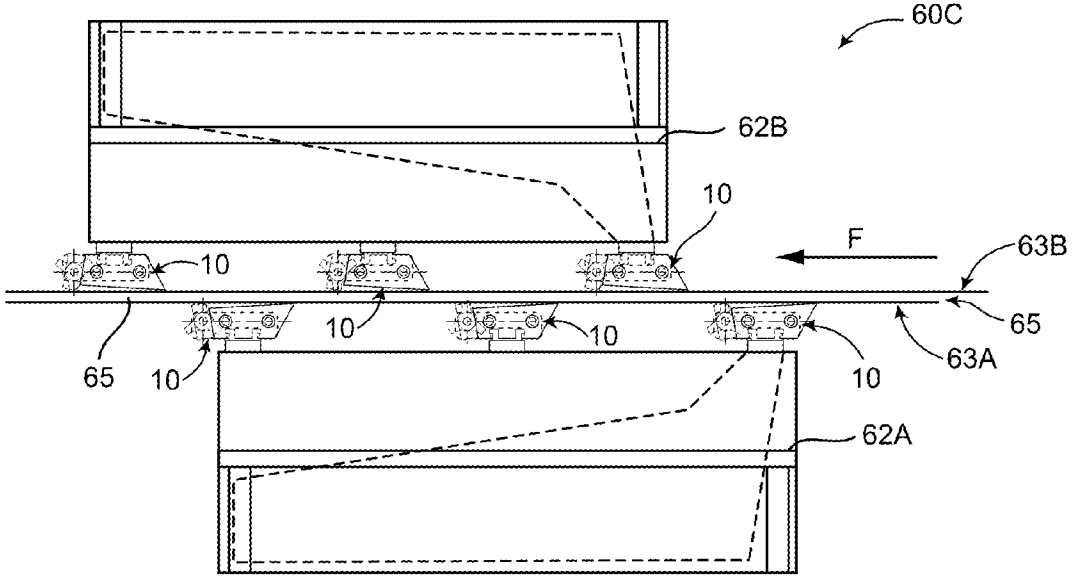
FIG. 6C is a side view of a twin wire forming paper machine including a plurality of foil apparatuses according to the present invention.

FIG. 6C is an illustration of a plurality of foil apparatus 10 in accordance with the present disclosure shown mounted to a twin wire forming paper making machine 60C. As shown in FIG. 6C, the paper making machine 60C includes lower and upper frames 62A, 62B respectively. The lower frame 62A is configured to carry an inner forming fabric 63A and the upper frame carries an outer forming fabric 63B; both of the inner and outer forming fabrics 63A, 63B configured for movement in the forming direction F relative to the frames 62A, 62B. A stock slurry 65 is delivered to and carried between the inner and outer forming fabrics 63A, 63B. The foil apparatuses 10 are configured and operate with respect to the associated forming fabric 63A, 63B in a similar way as that described above with respect to the gravity dewatering system of the paper making machine 60.

Figure 7:
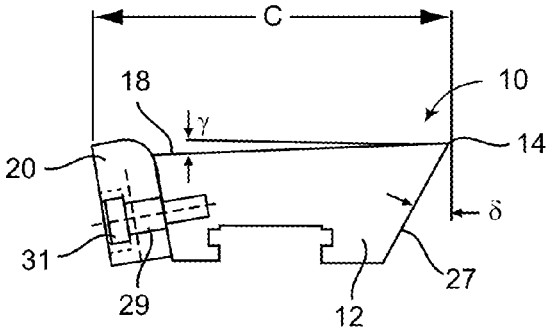
FIG. 7 is a schematic drawing of a foil member and pulse generator according to one embodiment of the present invention shown with the pulse generator in a "full up" position relative to the foil member.

Referring to FIG. 7, a foil apparatus 10 is shown with the pulse generator 20 in a "full up" position wherein the shaped surface 22 of the pulse generator is moved to a maximum height relative to the working surface 18 of the foil member. In one embodiment, the pulse generator 20 is movable relative to the foil member 12 so that the shaped surface 22 moves between about −0.125" below an edge (14, 16) of the foil member to about 0.5" above the edge of the foil member. As shown in FIG. 7, a typical overall width C of the foil member 12 with the pulse generator 20 attached thereto is in a range of about 2 inches to about 10 inches. A slope of the work surface 18 is identified as angle γ measured from a horizontal line perpendicular to a height of the foil member 12. The slope γ of the work surface 18 of the foil member is typically in a range of about zero degrees to about ten degrees measured from a horizontal line as shown in FIG. 7. The foil member 12 also includes an angular leading side 27 joining the working surface 18 at leading edge 14. Also shown in FIG. 7 is an angle of the leading side of the foil member 12 relative to a line perpendicular to the generally horizontal plane of the forming fabric 63 marked with the reference letter δ which is typically in a range of about zero degrees to about ninety degrees.

Figure 9:
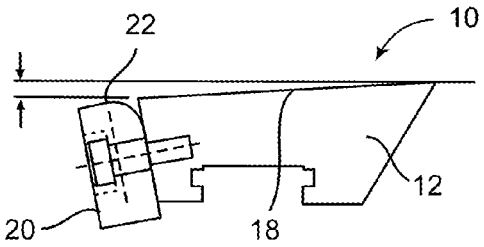
FIG. 9 is a schematic drawing of a foil member and pulse generator according to one embodiment of the present invention shown with the pulse generator in a "full down" position relative to the foil member.

FIG. 8 diagrams one embodiment of the foil apparatus 10 in operation as used in a paper making machine 60. Referring to FIGS. 7 and 8, the pulse generator 20 is positioned adjacent an edge (14, 16) of the work surface 18 of the foil member 12 for movement relative to the foil member 12 as described herein for the purpose of creating an adjustable nip 61 or space between the working surface 18 of the foil member 12, the shaped surface 22 of the pulse generator and a lower surface of the forming fabric 63. Thus, adjusting the position of the pulse generator 20 relative to the foil member 12 as set forth above, allows an operator to adjust a volume of the nip 61 by adjusting a dimension of the shaped surface 22 that engages the slurry stock 65 below the forming fabric 63 and identified as "E" on FIG. 8. Referring to FIGS. 7 and 9, the pulse generator 20 is movable relative to the foil member 12 between a "full up" position (FIG. 7) and a "full down" position (FIG. 9). As shown in FIG. 8, in a full up position, the shaped surface 22 of the pulse generator 20 engages a lower surface of the forming fabric 63, in part forming the nip 61 which causes water to drain from the slurry stock through the forming fabric and into the nip 61 and then to be forced back through the forming fabric at the obstructing shaped surface 22 of the pulse generator, which causes turbulence in the slurry stock 65 and mixing of the slurry stock which reduces flocculation. Adjustment of the position of the shaped surface 22 relative to the foil member 12 between the full up and full down positions is carried out by an operator for reducing flocculation in the slurry stock. Depending on various factors including, e.g., the quality and grade of the paper being made, a content and/or consistency of the slurry stock, and a process speed of the paper making machine 60, the pulse generator 20 is adjusted to increase or decrease the volume of the nip 61 for increasing or decreasing turbulence in the slurry stock above the forming fabric 63. In one embodiment of the pulse generator 20, the distance E between a full up and full down position is in a range of between about 0 inches and about 1.0 inches. In another embodiment, the range of movement E of the pulse generator 20 relative to the working surface 18 of the foil member 12 is about 0.5 inches.

Still referring to FIG. 8, the leading edge 14 of the foil member 12 and the angle δ thereof, diverts water 67 approaching the leading edge and below the forming fabric 63 away from the forming fabric and below the foil apparatus 10.

Referring again to FIG. 1, the foil apparatus includes a scale 54 attached to the working surface 18 of the foil member 12. A corresponding indicator 56 is coupled to the pulse generator 20. The scale 54 and indicator 56 cooperate to identify a position of the pulse generator 20 relative to the foil member 12. Although not shown, the scale 54 may include a "0" mark to identify a position wherein a high point of the shaped surface 22 of the pulse generator is flush with the working surface 18 of the foil member 12 such that the pulse generator is in a neutral position relative to the working surface 18.

FIG. 9 shows the foil apparatus 10 configured in a "full down" or neutral position wherein the shaped surface 22 of the pulse generator 20 is moved to a lowest position relative to the working surface 18 of the foil member 12. In some embodiments the full down position of the pulse generator 20 relative to the foil member 12 may include the shaped surface 22 being below an edge (14, 16) of the working surface 18 of the foil member 12 with respect to the forming fabric 63.

Figure 10:
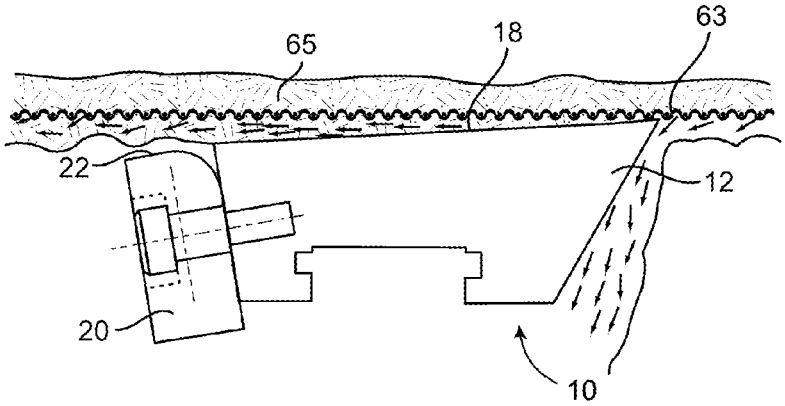
FIG. 10 is a diagram of a foil member and pulse generator of FIG. 9 shown as used in a paper making machine.

FIG. 10 provides an illustration of the foil apparatus 10 as configured in FIG. 9 in use in a paper making machine 60. As shown, the pulse generator 20 is positioned in a full down position relative to the foil member 12 such that water drained from the slurry stock through the forming fabric 63 and passing over the working surface 18 of the foil member 12 is not obstructed by the pulse generator and allowed to remain suspended below the forming fabric 63. Thus, in the full down position of the pulse generator 20 relative to the foil member 12, the pulse generator does not impede the flow of water below the forming fabric 63. Further, in the full down position, the pulse generator is effectively in a neutral position and therefore has little effect on a degree of turbulence or agitation in the slurry stock above the forming fabric 63.

Figure 11:
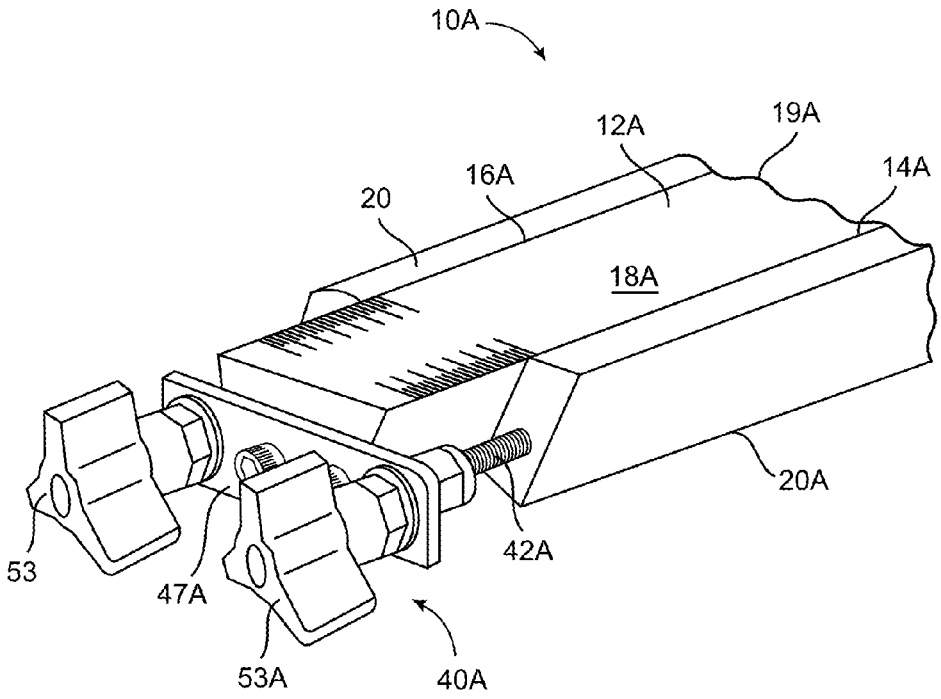
FIG. 11 is a partial perspective view of another embodiment of a foil apparatus in accordance with the present invention including first and second pulse generators coupled to each of a leading and a trailing edge of the foil member, respectively.

FIG. 11 shows another embodiment of a foil apparatus 10A in accordance with the present invention. The foil apparatus 10A is similar to the exemplary foil apparatus 10 shown in FIGS. 1-4 and includes both first and second pulse generators 20 and 20A coupled adjacent to each of the trailing edge 16 and leading edge 14 of the foil member 12, respectively. The second pulse generator 20A is substantially a mirror image of the pulse generator 20 described above, yet coupled adjacent the leading edge 14A of the foil member 12A. The pulse generator 20A is coupled for movement relative to the foil member 12 via actuator 40A and threaded rod 42A in a similar manner as set forth above with respect to the arrangement of pulse generator 20 shown in FIGS. 1-4 and described hereinabove. Bracket 47A is similar to bracket 47 described above, and includes all of the features thereof as well as a second slot 50A (not shown) to receive and support the second threaded rod 42A associated with the second pulse generator 20A in an arrangement similar to that described above with respect to bracket 47.

Figure 12:
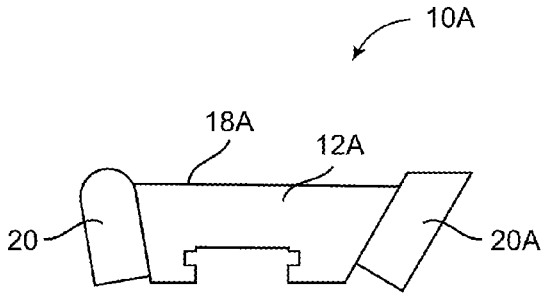
FIG. 12 is a schematic drawing of a foil member according to one embodiment of the present invention having first and second pulse generators shown with each of the pulse generators in a "full up" position relative to the foil member.

FIG. 12 is a schematic illustration of the foil apparatus 10A of FIG. 11 configured with both of the first pulse generator 20 and the second pulse generator 20A in full up positions relative to the foil member 12A disposed therebetween. The dimensional and functional relationships of component parts of the foil apparatus 10A are similar to those discussed above with respect to the foil apparatus 10 and therefore are not discussed further herein.

Figure 13:
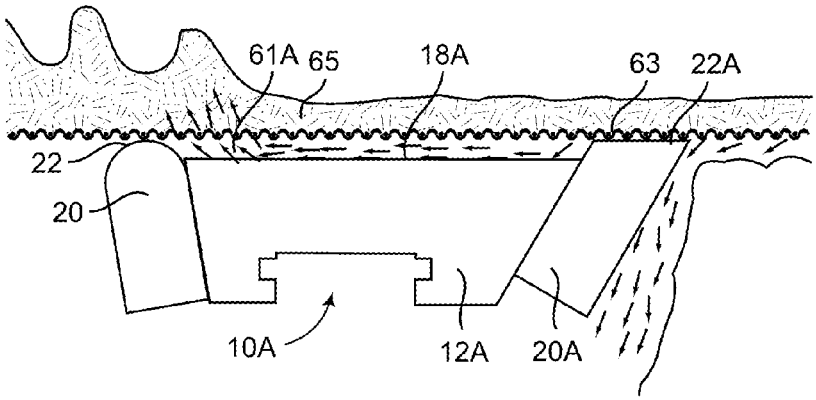
FIG. 13 is a diagram of the foil apparatus of FIG. 12 shown as used in a paper making machine.

FIG. 13 provides an illustration of the foil apparatus 10A as configured in FIG. 12 in use in a paper making machine 60. As shown, the first pulse generator 20 is positioned in a full up position relative to the foil member 12 and the second pulse generator 20A is positioned in a full up position relative to the foil member 12. Accordingly, a nip 61A is provided between the first and second pulse generators 20, 20A respectively, the working surface 18A of the foil member 12A and the forming fabric 63. Due to the full up position of the second pulse generator 20A, and engagement of both the first and second pulse generators 20, 20A with the forming fabric 63, the nip 61A extends across the entire width of the working surface 18A, thus the nip 61A is larger than that provided by the foil apparatus 10 described hereinabove. As set forth above with respect to the foil apparatus 10, water is allowed to drain via gravity or otherwise from the slurry stock 65 through the forming fabric 63 and into the nip 61A and then forced back through the forming fabric at the obstructing shaped surface 22 of the first pulse generator 20, which causes turbulence in the slurry stock 65 and mixing of the slurry stock which reduces flocculation. Adjustment of the positions of the shaped surfaces 22, 22A relative to the foil member 12A between the full up and full down positions is carried out by an operator for reducing flocculation in the slurry stock as discussed hereinabove with respect to foil apparatus 10. Depending on various factors including, e.g., the quality and grade of the paper being made, a content and/or consistency of the slurry stock, and a process speed of the paper making machine 60, the pulse generators 20 and 20A are adjusted to increase or decrease the volume of the nip 61A for increasing or decreasing turbulence in the slurry stock 65 above the forming fabric 63. The additional pulse generator 20A provides the foil apparatus 10A with the adjustability of both the first and second pulse generators 20, 20A throughout a full range of motion between the full down and full up positions of each and in combination one with the other. The various combinations of relative positions of the first and second pulse generators 20, 20A provides increased flexibility in the volume and geometry of the nip 61A when compared with prior art foil apparatus as well as the foil apparatus 10 disclosed herein. The adjustability of the pulse generator 20 relative to the foil member 12 will allow the operator of a paper making machine to generate high quality paper products of various grades while reducing a number of times a conventional foil member is removed and replaced with a foil member of a different specification as required using prior art foil members as described hereinabove.

Figure 14:
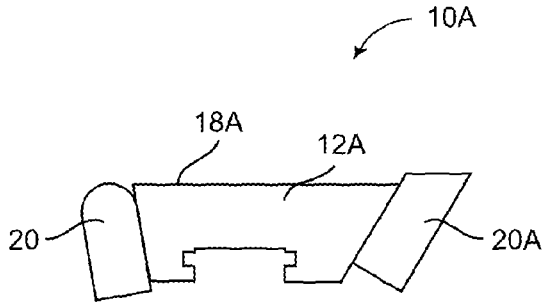
FIG. 14 is a schematic drawing of the foil apparatus of FIG. 11 shown with the pulse generator coupled to the leading edge in a "full up" position relative to the foil member, and the pulse generator coupled to the trailing edge in a "full down" position relative to the foil member.

FIG. 14 shows the foil apparatus 10A configured with the first pulse generator 20 in a full down position relative to the foil member 12A and the second pulse generator 20A in a full up position relative to the foil member 12A.

Figure 15:
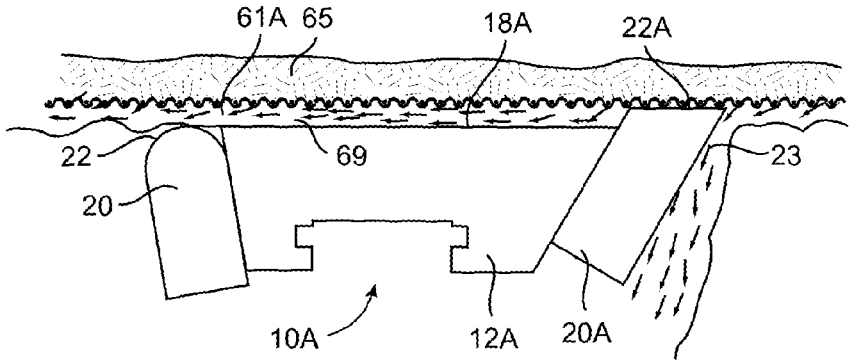
FIG. 15 is a diagram of the foil apparatus of FIG. 14 shown as used in a paper making machine.

FIG. 15 illustrates the foil apparatus 10A as configured in FIG. 14 in use in a paper making machine 60. As shown, the first pulse generator 20 is positioned in a full down position relative to the foil member 12 and the second pulse generator 20A positioned in a full up position relative to the foil member 12A. In the FIG. 15 configuration, the shaped surface 22A engages the underside of the forming fabric 63 causing water suspended under the forming fabric to collide with a forward facing surface 23 of the second pulse generator 20A which directs the water away from the forming fabric and below the foil apparatus 10A. As also shown in FIG. 15, the slurry stock 65 carried on the forming fabric 63 over the foil apparatus 10A drains water 69 from the slurry stock through the forming fabric and into the nip 61A. The water 69 drained from the slurry stock 65 through the forming fabric 63 and passing over the working surface 18 of the foil member 12 is not obstructed by the first pulse generator 20A (configured in a full down position) and allowed to remain suspended below the forming fabric 63. Thus, in the full down position relative to the foil member 12, the first pulse generator 20A does not impede the flow of water 69 below the forming fabric 63. Further, in the full down position, the first pulse generator 20A is effectively in a neutral position and therefore has little effect on a degree of turbulence or agitation in the slurry stock above the forming fabric 63. Adjustment of the second pulse generator 20A to a position between full up and full down reduces the volume of the nip 61 between the forming fabric and working surface 18A of the foil member 12A thereby allowing less water 69 to drain from the slurry stock 65 and into the nip 61A. Adjusting the first pulse generator 20 towards the forming fabric 63, will cause some of the water 69 to flow back through the forming fabric for agitating the stock slurry 63. Thus, the relative positions of the first and second pulse generators 20, 20A and the foil member 12 can be adjusted in various combinations to achieve a desired amount of agitation in the slurry stock 63.

Figure 16:
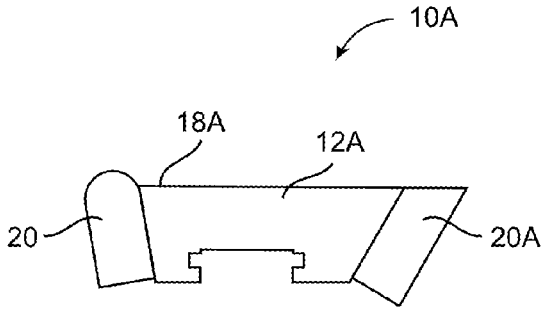
FIG. 16 is a schematic drawing of the foil apparatus of FIG. 11 shown with the pulse generator coupled to the leading edge in a "full down" position relative to the foil member, and the pulse generator coupled to the trailing edge in a "full up" position relative to the foil member.

FIG. 16 shows the foil apparatus 10A configured with the first pulse generator 20 in a full up position relative to the foil member 12A and the second pulse generator 20A in a full down position relative to the foil member 12A.

Figure 17:
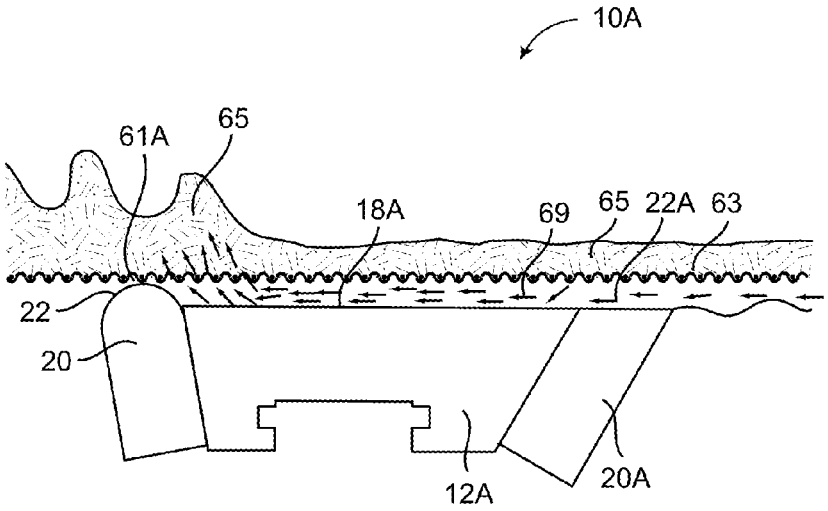
FIG. 17 is a diagram of the foil apparatus of FIG. 16 shown as used in a paper making machine.

FIG. 17 illustrates the foil apparatus 10A as configured in FIG. 16 in use in a paper making machine 60. As shown, the first pulse generator 20 is positioned in a full up position relative to the foil member 12 and the second pulse generator 20A positioned in a full down position relative to the foil member 12A. As configured, the shaped surface 22A is spaced apart from the underside of the forming fabric 63 causing water suspended under the forming fabric to pass over the working surface 18A of the foil apparatus 12A. As also shown in FIG. 17, the slurry stock 65 carried on the forming fabric 63 over the second pulse generator 20A and the foil member 12 drains water 69 from the slurry stock through the forming fabric and into the nip 61A. The water 69 drained from the slurry stock 65 through the forming fabric 63 and passing over the working surface 18 of the foil member 12 is then obstructed by the shaped surface 22 of the first pulse generator 20 and forced back through the forming fabric 63. Still referring to FIG. 17, in a full up position, the shaped surface 22 of the first pulse generator 20 engages a lower surface of the forming fabric 63, in part forming the nip 61A which in part, allows the water 69 to drain from the slurry stock 65 through the forming fabric and into the nip 61A. The water 69 is then forced back through the forming fabric at the obstructing shaped surface 22 of the first pulse generator 20, which causes turbulence in the slurry stock 65 and mixing of the slurry stock which reduces flocculation therein. Adjustment of the positions of the shaped surfaces 22, 22A relative to the foil member 12A between the full up and full down positions is carried out by an operator for reducing flocculation in the slurry stock. Depending on various factors including, e.g., the quality and grade of the paper being made, a content and/or consistency of the slurry stock, and a process speed of the paper making machine 60, the pulse generators 20, 20A are adjusted to increase or decrease the volume of the nip 61A for increasing or decreasing turbulence in the slurry stock 65 above the forming fabric 63.

Figure 18:
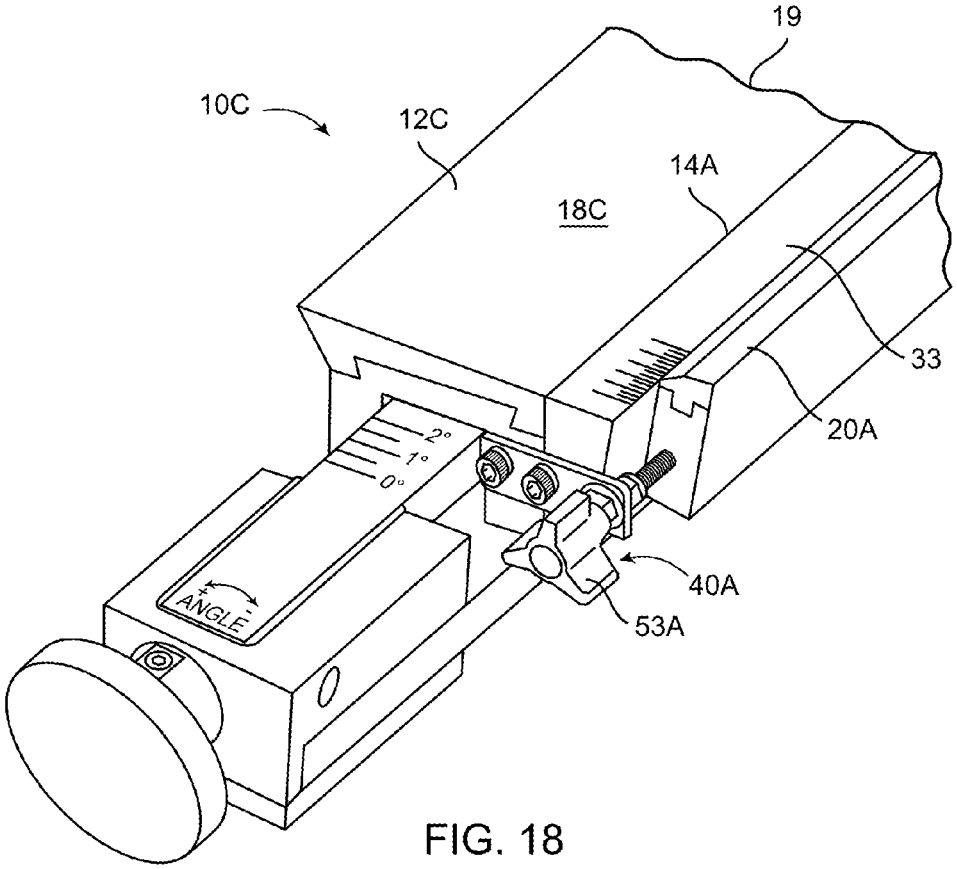
FIG. 18 is a partial perspective view of another embodiment of a foil apparatus in accordance with the present invention including a foil member having an adjustable work surface and a pulse generator coupled adjacent a trailing edge thereof.
Figure 19:
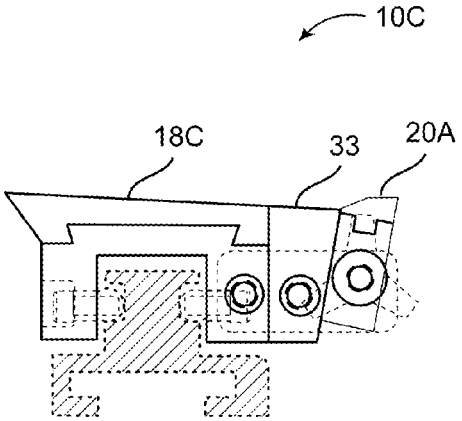
FIG. 19 is a partial end view of the foil apparatus of FIG. 18.
Figure 20:
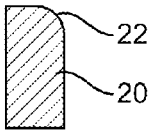
FIGS. 20-27 are cross-sectional views of various pulse generators in accordance with the present invention taken at line D-D of FIG. 3; each of the views showing a pulse generator defining a different shaped surface for engaging the forming fabric of a paper making machine.
Figure 21:
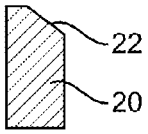
Figure 22:
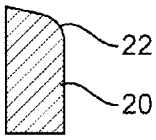
Figure 23:
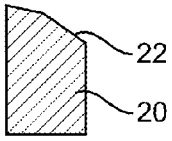
Figure 24:
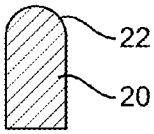
Figure 25:
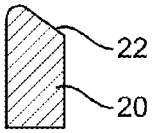
Figure 26:
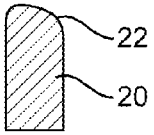
Figure 27:
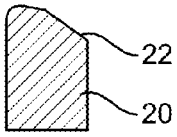

FIGS. 18 and 19 show another embodiment of a foil apparatus 10C according to the present invention including a pulse generator 20A coupled to a foil member 12B having an adjustable angle working surface 18C. The foil apparatus 10C is similar in operation to the foil apparatus 10 and 10A described herein above. An intermediate member 33 may be included between an edge 14A and the pulse generator 20A to facilitate coupling the pulse generator to the adjustable body of the foil apparatus 10C. The operation and function of the pulse generator 20A and foil apparatus 10C are similar to that discussed hereinabove with respect to foil apparatus 10 and 10A. The angular adjustability of the working surface 18C which is known, in combination with the adjustable pulse generator 20A, provides yet another embodiment of the disclosed foil apparatus. In another embodiment (not shown) first and second pulse generators 20, 20A are coupled to the trailing and leading edges of the adjustable angle working surface 18C. As will be apparent to one skilled in the art, the adjustable working surface 18C in combination with one or more pulse generators (20, 20A) each being movable relative to the working surface 18C between full up and full down positions as described hereinabove, provides a foil apparatus 10C capable of providing variable configurations and degrees thereof for mixing the slurry stock of a paper making machine in a selectable manner. For example, the angular adjustability of the working surface 18C in combination with one or more adjustable pulse generators 20, 20A coupled to the foil member 12C provides numerous possibilities for configuring a nip 61 for carrying water 69 below the forming fabric 63 in accordance with the present invention.

FIGS. 20-27 show the cross sections of various pulse generators (20, 20A) in accordance with the present invention foil apparatus 10. The shaped surfaces 22 of varied pulse generators illustrated in FIGS. 20-27 provide examples of various surfaces suitable for engagement with the slurry stock 65 and/or water 69 for creating turbulence and/or reducing flocculation in the slurry stock as mentioned herein. The various shaped surfaces 22 shown in FIGS. 20-27 are designed for the varied stocks and forming fabrics used in the paper making industries.

Typically the materials used for the pulse generators 20 and working surfaces 18 of the disclosed foil apparatus 10, 10A, 10C include one or more of plastic, polymers, ceramic, fiberglass, stainless steel and other types of wearable or wear resistant materials which are known to those skilled in the art.

Also provided is a method of dewatering a forming fabric in a paper making machine, the method including the steps of: moving a forming fabric carrying a slurry stock through a dewatering area of the paper making machine; positioning a foil apparatus relative to a frame for supporting the forming fabric, the foil apparatus comprising an elongated foil member defining a work surface postionable relative to the forming fabric, and an elongated pulse generator coupled to the foil member along a length of the foil member, the pulse generator being mounted adjacent the work surface; forming a nip between the work surface and the forming fabric by positioning the puke generator relative to the work surface, the nip for creating movement in a slurry stock of the paper making machine for reducing flocculation in the slurry stock.

The method further including a step of adjusting a volume of the nip by moving the pulse generator relative to the work surface.

The method further including coupling the pulse generator to the foil member via a shoulder bolt extending through a slot defined by the pulse generator and secured to the foil member.

The method further including operating an actuator for moving the pulse generator relative to the work surface.

The method further including a step of coupling a first pulse generator adjacent to a trailing edge of the working surface of the foil member and coupling a second pulse generator adjacent a leading edge of the working surface of the foil member.

The method further including a step of moving one or both of the first and second pulse generators relative to the foil member and creating a nip between the forming fabric and the work surface of the foil apparatus for reducing flocculation in the slurry stock.

The method further including adjusting an angle of the working surface relative to a plane or the forming fabric.

Example embodiments and methods thus being described, it will be appreciated by one skilled in the art that example embodiments and example methods may be varied through routine experimentation and without further inventive activity. For example, while the disclosure describes foil apparatus useable with a paper making machine, internal spacing elements or other intermediate elements and/or variations of the disclosed embodiments may be used in connection with the foil apparatus described herein and achieve the same functions as disclosed herein. Variations are not to be regarded as departure from the spirit and scope of the exemplary embodiments, and all such modifications as would be obvious to one skilled in the art are intended to be included within the scope of the following claims.

What is claimed is:

1. A method of dewatering a forming fabric in a paper making machine, the method comprising:

moving a forming fabric carrying a slurry stock through a dewatering area of the paper making machine;

positioning a foil apparatus relative to a frame for supporting the forming fabric, the foil apparatus comprising an elongated foil member defining a work surface postionable relative to the forming fabric, and an elongated pulse generator coupled to the foil member along a length of the foil member, the pulse generator being mounted adjacent the work surface; and forming a nip between the work surface and the thrilling fabric by positioning the puke generator relative to the work surface, the nip for creating movement in a slurry stock of the paper making machine for reducing flocculation.

2. The method of claim 1 further comprising a step of adjusting a volume of the nip by moving the pulse generator relative to the work surface.

3. The method of claim 1 further comprising operating an actuator for moving the pulse generator relative to the work surface.

* * * * *